US007000295B2

(12) United States Patent
Andrews

(10) Patent No.: US 7,000,295 B2
(45) Date of Patent: Feb. 21, 2006

(54) COMPOSITE YARN, INTERMEDIATE FABRIC PRODUCT AND METHOD OF PRODUCING A METALLIC FABRIC

(75) Inventor: Gregory V. Andrews, Concord, NC (US)

(73) Assignee: World Fibers, Inc., Concord, NC (US)

( * ) Notice: Subject to any disclaimer, the term of this patent is extended or adjusted under 35 U.S.C. 154(b) by 115 days.

(21) Appl. No.: 10/955,648

(22) Filed: Sep. 30, 2004

(65) Prior Publication Data

US 2005/0069685 A1 Mar. 31, 2005

Related U.S. Application Data

(60) Continuation of application No. 10/397,078, filed on Mar. 26, 2003, now abandoned, which is a division of application No. 09/829,774, filed on Apr. 10, 2001, now Pat. No. 6,803,332.

(51) Int. Cl.
*D06M 10/00* (2006.01)

(52) U.S. Cl. ..... 28/168; 28/170; 57/6

(58) Field of Classification Search ..... 28/168, 28/170, 169, 167, 165, 166, 171; 57/210, 57/225, 212–223, 3, 5, 6, 7, 9–13; 428/222, 428/364, 365, 373, 377, 371, 379, 370, 911; 442/310, 316, 197, 228, 229, 376, 377
See application file for complete search history.

(56) References Cited

U.S. PATENT DOCUMENTS

| | | | | |
|---|---|---|---|---|
| 1,759,410 | A * | 5/1930 | Marston | 57/222 |
| 2,052,875 | A * | 9/1936 | Gammons et al. | 28/155 |
| 2,189,412 | A * | 2/1940 | Arnone | 431/325 |
| 2,342,098 | A * | 2/1944 | Alderfer | 139/421 |
| 2,592,154 | A * | 4/1952 | Johnson et al. | 28/168 |
| 3,146,576 | A * | 9/1964 | Wezel | 57/33 |
| 3,602,964 | A * | 9/1971 | Currier et al. | 28/158 |
| 3,769,787 | A * | 11/1973 | Rosenstein et al. | 57/227 |
| 4,764,779 | A * | 8/1988 | Sato et al. | 343/897 |
| 4,776,160 | A * | 10/1988 | Rees | 57/210 |
| 4,777,789 | A * | 10/1988 | Kolmes et al. | 57/210 |
| 5,062,161 | A * | 11/1991 | Sutton | 2/169 |
| 5,213,865 | A * | 5/1993 | Yamada | 428/92 |
| 5,287,690 | A * | 2/1994 | Toon | 57/210 |
| 5,442,815 | A | 8/1995 | Cordova et al. | |
| 5,455,114 | A * | 10/1995 | Ohmory et al. | 428/364 |
| 5,555,716 | A * | 9/1996 | Dugan | 57/224 |
| 5,632,137 | A * | 5/1997 | Kolmes et al. | 57/212 |
| 5,699,680 | A * | 12/1997 | Guerlet et al. | 66/202 |

(Continued)

FOREIGN PATENT DOCUMENTS

| | | | |
|---|---|---|---|
| FR | 2668176 | A1 * | 4/1992 |

(Continued)

*Primary Examiner*—Amy Vanatta
(74) *Attorney, Agent, or Firm*—Adams Evans P.A.

(57) ABSTRACT

A method for forming a metallic fabric includes forming a composite yarn having a metallic wire core, and a cover yarn including a fluid-soluble strand such as co-nylon or polylactic acid. The composite yarn can be knitted into an intermediate fabric product. The soluble element is dissolved to leave a use fabric suitable for other processing, such as coating with materials such as latex. The non-fluid-soluble strand may be either a single strand or multi-filaments of steel wire.

20 Claims, 5 Drawing Sheets

U.S. PATENT DOCUMENTS

| | | | | |
|---|---|---|---|---|
| 5,721,179 | A | 2/1998 | Shi et al. | |
| 5,806,295 | A * | 9/1998 | Robins et al. | 57/220 |
| 6,363,703 | B1 * | 4/2002 | Kolmes | 57/210 |
| 6,581,366 | B1 * | 6/2003 | Andrews | 57/225 |
| 6,826,898 | B1 * | 12/2004 | Hummel | 57/210 |
| 6,880,319 | B1 * | 4/2005 | Zhu | 57/3 |

FOREIGN PATENT DOCUMENTS

| | | | |
|---|---|---|---|
| JP | 53103063 | A1 * | 9/1978 |
| JP | 6261747 | A1 * | 3/1987 |
| JP | 6093531 | A1 * | 4/1994 |
| JP | 9059839 | A1 * | 3/1997 |
| WO | WO 9533877 | * | 12/1995 |

* cited by examiner

COMPOSITE YARN, INTERMEDIATE FABRIC PRODUCT AND METHOD OF PRODUCING A METALLIC FABRIC

This application is a continuation of U.S. application Ser. No. 10/397,078, filed Mar. 26, 2003, now abandoned, which is a divisional application of U.S. application Ser. No. 09/829,774, filed Apr. 10, 2001, now U.S. Pat. No. 6,803,332.

TECHNICAL FIELD AND BACKGROUND OF THE INVENTION

The invention relates to a composite yarn, intermediate fabric product and method of producing a metallic fabric. In general, the composite yarn is made to be partially soluble, so that the soluble part can be removed by dissolving after an intermediate fabric product is formed to leave a non-soluble use fabric, which may then be subjected to further processing.

In the particular application disclosed herein by way of example, a two-component yarn is knitted into a glove, the soluble component removed by dissolution to leave a non-water-soluble use fabric glove, and the glove is then coated with a latex material. Such a glove is useful in the food industry where latex gloves are used by food processing workers. Occasionally pieces of latex are broken or cut off of the glove and become mixed with the food being processed. The presence of the metallic wire permits the latex to be located by use of x-ray examination or other metal detection devices so that the latex can be removed or the batch of contaminated food disposed of.

SUMMARY OF THE INVENTION

Therefore, it is an object of the invention to provide a composite yarn having a fluid-soluble component and a non-fluid-soluble component.

It is another object of the invention to provide a composite yarn which is suitable for forming into an intermediate fabric product, whereupon a soluble component is dissolved leaving a non-soluble component forming a use fabric suitable for further processing.

It is another object of the invention to provide an intermediate fabric product of a composite yarn having a fluid-soluble component and a non-fluid-soluble component.

It is another object of the invention to provide an intermediate fabric product of a composite yarn which is suitable for forming into an intermediate fabric product, whereupon a soluble component is dissolved leaving a non-soluble component forming a use fabric suitable for further processing.

It is another object of the invention to provide a method of forming a composite yarn having a fluid-soluble component and a non-fluid-soluble component.

It is another object of the invention to provide a method of forming an intermediate fabric product of a composite yarn having a fluid-soluble component and a non-fluid-soluble component.

It is another object of the invention to provide a method of forming an intermediate fabric product of a composite yarn which is suitable for forming into an intermediate fabric product, whereupon a soluble component is dissolved leaving a non-soluble component forming a use fabric suitable for further processing.

It is another object of the invention to provide a knitted glove made from a composite yarn formed into an intermediate fabric product from which a soluble fiber component is removed to leave a metallic use fabric glove which is then coated with a latex product.

These and other objects of the present invention are achieved in the preferred embodiments disclosed below by providing a composite yarn, comprising a core yarn, and a cover yarn, wherein one of the core yarn and the cover yarn comprises a fluid-soluble strand and the other of the core yarn and cover yarn comprises a non-fluid-soluble strand.

According to one preferred embodiment of the invention, the core yarn comprises a water-soluble fiber.

According to another preferred embodiment of the invention, the cover yarn comprises a metallic wire, which may be either a mono-filament strand, or a multi-filament strand.

According to yet another preferred embodiment of the invention, the core yarn comprises a multi-filament water-soluble fiber yarn and the cover yarn comprises a single strand of metallic wire.

According to yet another preferred embodiment of the invention, the water-soluble core yarn is selected from the group consisting of polyvinyl alcohol and co-nylon.

According to yet another preferred embodiment of the invention, the core yarn comprises 760 denier/48 filament yarn.

According to yet another preferred embodiment of the invention, the core yarn comprises a multi-filament yarn having a denier of between 20 and 2,000.

According to yet another preferred embodiment of the invention, the wire comprises a 0.002 stainless steel wire.

According to yet another preferred embodiment of the invention, an intermediate fabric product is provided which is intended for subsequent processing into a metallic fabric suitable for fabrication, and comprising a fabric comprised of a core yarn, and a cover yarn, wherein one of the core yarn and the cover yarn comprises a fluid-soluble strand and the other of the core yarn and cover yarn comprises a non-fluid-soluble strand which can be dissolved after formation of the intermediate fabric product.

According to yet another preferred embodiment of the invention, the intermediate fabric product includes a core yarn comprised of a water-soluble fiber.

According to yet another preferred embodiment of the invention, the intermediate fabric product includes a cover yarn comprised of a metallic wire.

According to yet another preferred embodiment of the invention, the intermediate fabric product includes a core yarn comprised of a multi-filament water-soluble fiber yarn and a cover yarn comprised of a single strand of metallic wire.

According to yet another preferred embodiment of the invention, the intermediate fabric product includes a water-soluble core yarn selected from the group consisting of polyvinyl alcohol and co-nylon.

According to yet another preferred embodiment of the invention, the intermediate fabric product has a core yarn comprised of 760 denier/48 filament yarn.

According to yet another preferred embodiment of the invention, the intermediate fabric product has a core yarn comprised of a multi-filament yarn having a denier of between 20 and 2,000.

According to yet another preferred embodiment of the invention, the intermediate fabric product includes a 0.002 inch stainless steel wire.

According to yet another preferred embodiment of the invention, the intermediate fabric product comprises a knitted fabric.

An embodiment of the method of producing a metallic fabric according to the invention comprises providing a composite yarn having a metallic wire, a fluid-soluble strand, and an elastomeric wire. The composite yarn includes a core yarn and a cover yarn, and the core yarn comprises the fluid-soluble strand. The composite yarn is formed into an intermediate fabric, and the fluid-soluble strand is dissolved, thereby forming a use fabric comprised of the remaining non-fluid soluble strand.

According to one preferred embodiment of the method, the step of forming the composite yarn into a fabric comprises knitting the composite yarn into a knitted fabric.

According to another preferred embodiment of the method, the step of forming the composite yarn into a fabric comprises knitting the composite yarn into a knitted glove.

According to yet another preferred embodiment of the method, the core yarn comprises a water-soluble fiber.

According to yet another preferred embodiment of the method, the cover yarn comprises a metallic wire.

According to yet another preferred embodiment of the method, the core yarn comprises a multi-filament water-soluble fiber yarn and the cover yarn comprises a single strand of metallic wire.

According to yet another preferred embodiment of the method, the water-soluble core yarn is selected from the group consisting of polyvinyl alcohol and co-nylon.

According to yet another preferred embodiment of the invention, the core yarn comprises 760 denier/48 filament yarn.

According to yet another preferred embodiment of the invention, the core yarn comprises a multi-filament yarn having a denier of between 20 to 2,000.

According to yet another preferred embodiment of the invention, the wire comprises a 0.002 stainless steel wire.

According to yet another preferred embodiment of the invention, the intermediate fabric product comprises a knitted fabric.

According to yet another preferred embodiment of the invention, the step of forming the composite yarn comprises the step of wrapping a metallic cover strand around a water-soluble fiber core.

According to yet another preferred embodiment of the invention, the step of wrapping a metallic cover strand around a water-soluble fiber core comprises the step of wrapping the metallic cover strand around the water-soluble fiber core at a rate of six turns per inch.

According to yet another preferred embodiment of the method, the use fabric is coated with a protective cover.

According to yet another preferred embodiment of the method, the use fabric is coated with a latex material.

According to yet another preferred embodiment of the method, the step of forming the composite yarn into an intermediate fabric comprises the step of knitting the composite yarn into an article of apparel, and includes the step of coating the use fabric article of apparel with a latex material.

According to yet another preferred embodiment of the method, the step of forming the composite yarn into an intermediate fabric comprises the step of knitting the composite yarn into a glove, and includes the step of coating the use fabric glove with a latex material.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
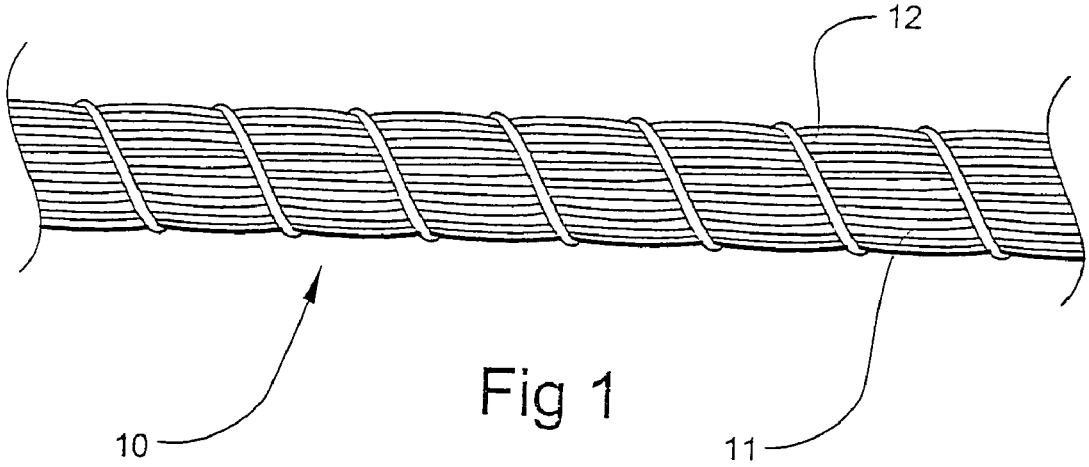
FIG. 1 is a schematic view of a composite yarn according to an embodiment of the invention.

Referring now specifically to the drawings, a composite yarn according to the present invention is illustrated in FIG. 1 and shown generally at reference numeral 10. This particular yarn is representative of many yarns which can be constructed in accordance with the invention. The composite yarn 10 includes a water soluble core yarn 11 around which is wrapped a non-water-soluble cover strand, for example, a stainless steel wire. The composite yarn 10 is thus sufficiently flexible with a sufficient amount of exposed core yarn to be knittable on conventional knitting machines or woven on conventional looms. The steel wire may also be a multi-filament wire, such as 9 ends of 0.002 inch stainless steel. Wire diameters will preferably fall with the range of 0.0008 to 0.014 inch.

Suitable water-soluble fibers may include but are not limited to poly-vinyl alcohol (PVA), co-nylon (co-polyamide nylon such as H.B. Fuller Co. product number NF-2074, or polylactic acid (cornstarch).

The non-water-soluble strand can be any one of a wide variety of fibers and non-fibrous mono-filament or multi-filament strands which do not dissolve in water, including but not limited to polyamides, polyesters, acrylics, and numerous engineered high-strength and flame-resistant fibers, natural fibers such as cotton, wool, flax and ramie, single or multiple metallic strands such as copper and steel, and mineral fibers such as glass, and blends of these fibers.

The non-soluble component can be either the core or cover element of the composite yarn depending on processing requirements.

The invention is illustrated by the following examples:

EXAMPLE 1

| | |
|---|---|
| Core yarn: | co-nylon water-soluble yarn, 760 denier/48 filament, 4 g/den tenacity |
| Cover yarn: | .002 inch stainless steel wire |
| Wrap rate: | 6 turns/inch |

Other examples include the use of 0.0016 inch stainless steel wire as a wrapper over a core of either a 750 denier co-nylon or a 500 denier PVA fiber.

Alternatively, a multi-filament steel wire, such as 9 ends of 0.002 inch stainless steel, can be used as a core yarn, wrapped with, for example, Z and S strands of 750 denier co-nylon.

Further alternatives include a core yarn of 750 denier co-nylon with a Z cover of 9 ends of 0.002 inch stainless steel wire and an S-cover of 750 denier co-nylon.

An elastomer, such as Spandex or rubber, may also be used as a component in the composite yarn, which is then formed into an intermediate fabric product, such as the glove described below. The elastomer, which remains after the soluble component has been removed and provides shape retention of the formed article. The Spandex is preferably between 10–1040 denier. Rubber is preferably between 110–35 gauge.

The wrapping was done on a conventional yarn wrapping machine.

Figure 2:
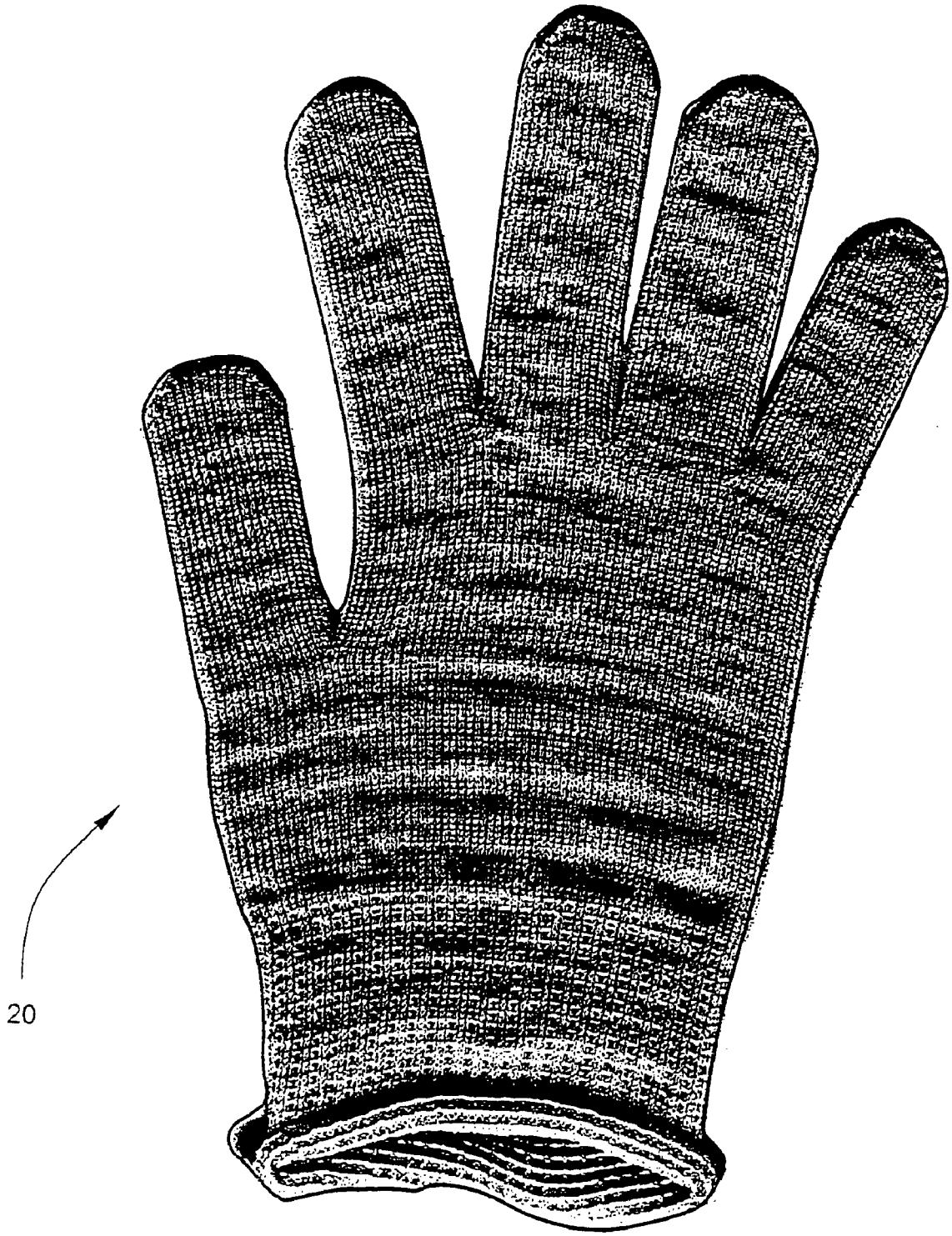
FIG. 2 is an intermediate fabric glove knitted from the composite yarn.

The composite yarn of Example 1 was knitted into a glove 20 (FIG. 2) on an unmodified Shima Seike 13 gauge, 78 needle knitting machine. As is shown in FIG. 2, the glove 20 appears to be a conventional glove knitted from a composite yarn and of the type used by meat cutters and others who use sharp implements.

Figure 3:
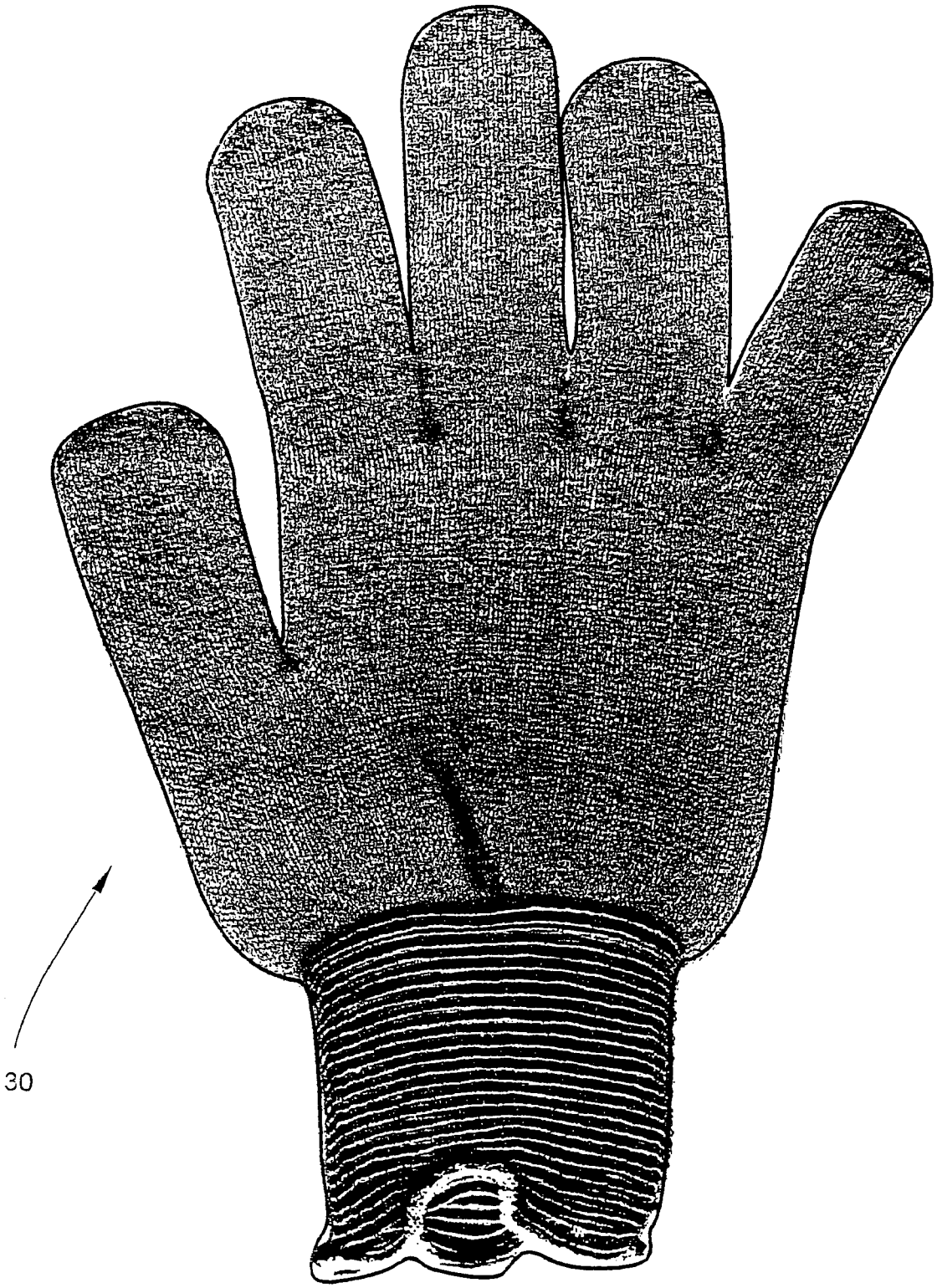
FIG. 3 is the glove of FIG. 2 after the soluble component of the yarn has been dissolved.
Figure 4:
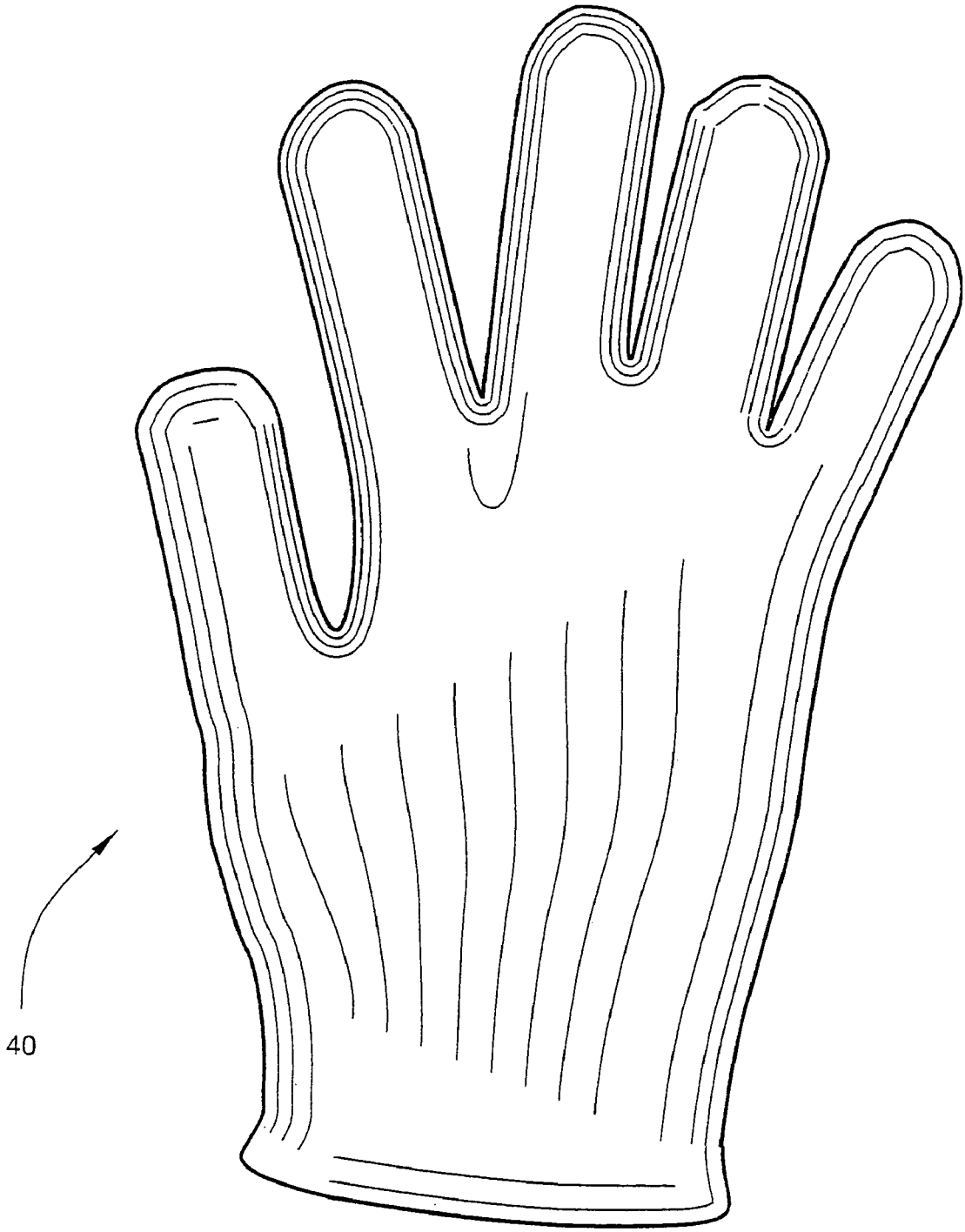
FIG. 4 is the glove of FIG. 2 after the remaining metal skeleton has been coated with latex.

The glove 20 was then immersed in a bath of tap water at ambient temperature for approximately 45 seconds. The soluble co-nylon was completely dissolved and rinsed away by this process, leaving a use fabric in the form of a perfectly-formed, knitted steel mesh glove 30 (see FIG. 3) with no trace of the soluble fiber which enabled it to be knitted in a conventional manner. The glove 30 may be subsequently processed in any desirable manner, including coating the glove in a latex material, such as synthetic or natural rubber or other suitable polymers and flexible plastics to form a flexible rubber glove 40 (see FIG. 4) having a metal skeleton rendering it easily detectable by x-ray or other metal-detecting devices. Use of Spandex or rubber in combination with the steel wire will cause the glove 30 to more closely conform to the shape of the dipping form on which the glove 30 is placed when the glove 30 is dipped into the latex or other coating liquid when forming the glove 40.

Figure 5:
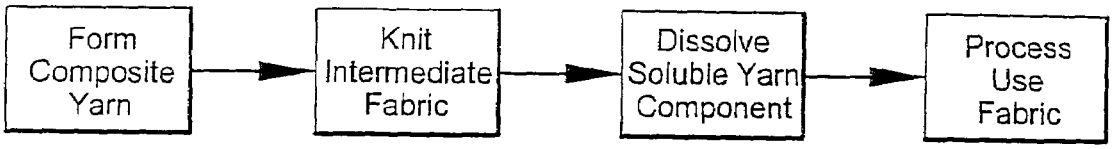
FIG. 5 is a flow chart of the method according to the invention.

The process described above is shown graphically in FIG. 5. The composite yarn can also be used to form other fabrics, including non-woven mats.

A composite yarn, intermediate fabric product and method of producing a metallic fabric is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A method of producing a metallic fabric, comprising the steps of:

(a) providing a composite yarn comprising:

(i) a metallic wire, (ii) a fluid-soluble strand, (iii) an elastomeric strand, and (iv) wherein the composite yarn includes a core and a cover wrapped around the core, the core comprising the fluid-soluble strand;

(b) forming the composite yarn into an intermediate fabric; and (c) dissolving the fluid-soluble strand, thereby forming a use fabric comprised of the remaining metallic wire.

2. A method according to claim 1, wherein the step of forming the composite yarn into a fabric comprises knitting the composite yarn into a knitted fabric.

3. A method according to claim 1, wherein the step of forming the composite yarn into a fabric comprises knitting the composite yarn into a knitted glove.

4. A method according to claim 1, wherein the step of providing the composite yarn includes providing a composite yarn having a metallic wire comprising a multi-filament stainless steel wire.

5. A method according to claim 1, wherein the step of providing the composite yarn includes providing a composite yarn having a metallic wire comprising stainless steel wire having a diameter of 0.002 inch.

6. A method according to claim 1, wherein the intermediate fabric comprises a knitted fabric.

7. A method according to claim 1, the cover is wrapped around the core at a rate of six turns per inch.

8. A method according to claim 1, and including the step of coating the use fabric with a protective cover.

9. A method according to claim 1, wherein the step of forming the composite yarn into an intermediate fabric comprises knitting the composite yarn into an article of apparel, wherein the elastomeric strand remains after the dissolving of the fluid-soluble strand to retain a predetermined shape of the article of apparel.

10. A method according to claim 1, and including the step of coating the use fabric with a latex material.

11. A method according to claim 1, wherein the step of forming the composite yarn into an intermediate fabric comprises the step of knitting the composite yarn into an article of apparel, and further includes the step of coating the use fabric article of apparel with a latex material.

12. A method according to claim 1, wherein the step of forming the composite yarn into an intermediate fabric comprises the step of knitting the composite yarn into a glove, and includes the steps of coating the use fabric glove with a latex material.

13. A method according to claim 1, wherein the fluid-soluble strand is selected from the group consisting of co-nylon and polylactic acid.

14. A method according to claim 1, wherein the core further comprises the elastomeric strand.

15. A method according to claim 1, wherein the cover comprises the elastomeric strand.

16. A method according to claim 1, wherein the core further comprises the metallic wire.

17. A method according to claim 1, wherein the cover comprises the metallic wire.

18. A method according to claim 17, wherein the cover further comprises the elastomeric strand.

19. A method according to claim 1, wherein the core further comprises the elastomeric strand, and the cover comprises the metallic wire.

20. A method according to claim 1, wherein the fluid-soluble strand comprises a water-soluble, multi-filament yarn having a denier of between 20 and 2,000.

* * * * *